US009839915B2

(12) United States Patent
Hunker

(10) Patent No.: US 9,839,915 B2
(45) Date of Patent: Dec. 12, 2017

(54) IMPACT GRINDING PLANT FOR THE COMMUNITION OF ORE

(71) Applicant: Carey Hunker, Vancouver (CA)

(72) Inventor: Carey Hunker, Vancouver (CA)

( * ) Notice: Subject to any disclaimer, the term of this patent is extended or adjusted under 35 U.S.C. 154(b) by 769 days.

(21) Appl. No.: 14/093,014

(22) Filed: Nov. 28, 2013

(65) Prior Publication Data

US 2015/0144718 A1 May 28, 2015

(51) Int. Cl.
*B02C 19/00* (2006.01)
*B02C 19/16* (2006.01)
(Continued)

(52) U.S. Cl.
CPC ..... *B02C 19/0012* (2013.01); *B02C 19/16* (2013.01); *B02C 23/02* (2013.01); *B02C 23/12* (2013.01)

(58) Field of Classification Search
CPC ..... B01F 7/00641; B01F 7/00625; B01F 7/00633; B01F 9/0007; B01F 9/001; B01F 9/0012; B02C 18/04; B02C 19/00; B02C 2210/01; B02C 23/00; B02C 23/38; B02C 23/10; B02C 23/08; B02C 23/12; B02C 17/10; B02C 2018/147; B02C 21/007; B02C 17/00; B02C 17/06; B02C 21/00; B02C 17/161; B02C 17/168; B02C 17/18; B02C 17/183; B02C 17/1835; B02C 17/184; B02C 17/1845; B02C 17/185; B02C 17/1855; B02C 17/20;
(Continued)

(56) References Cited

U.S. PATENT DOCUMENTS 2,006,269 A 6/1935 Hadsel
2,016,793 A * 10/1935 Tveit ..... B02C 19/0012 198/711
(Continued)

FOREIGN PATENT DOCUMENTS

EP 1741628 A1 10/2007
WO 2011041841 A1 4/2011

OTHER PUBLICATIONS

After Final Arguments Apr. 5, 2017.*
(Continued)

*Primary Examiner* — R. K. Arundale
*Assistant Examiner* — Joseph Finan, Jr.
(74) *Attorney, Agent, or Firm* — Cameron IP

(57) ABSTRACT

There is provided an impact grinding assembly. The assembly, according to one aspect, includes a pair of conveyors for conveying at least partially unground material. Each conveyor has a lower portion and an upper portion which is spaced-apart above its lower portion. The assembly includes a pair of vibrating impact plates aligning below the upper portions of respective ones of the conveyors to receive the at least partially unground material. A first one of the impact plates operatively directs material thereon to the lower portion of a second one of the conveyors. A second one of the impact plates operatively directs material thereon to the lower portion of a first one of the conveyors. The impact grinding assembly may further include a material-separation assembly for removing material from the conveyors which has a particle size no greater than a desired particle size.

21 Claims, 9 Drawing Sheets

(51) Int. Cl.
*B02C 23/02* (2006.01)
*B02C 23/12* (2006.01)

(58) Field of Classification Search
CPC ..... B02C 17/205; B02C 17/24; B02C 17/14; B02C 19/16; B02C 2013/28636; B02C 2013/28645; B02C 18/2241; B02C 18/225; C12M 45/02
See application file for complete search history.

(56) References Cited

U.S. PATENT DOCUMENTS 2,018,232 A * 10/1935 Silver ..... B02C 19/0012 241/284
2,032,247 A 2/1936 Beers
2,047,171 A * 7/1936 Ball ..... B02C 19/0012 241/274
2,091,772 A * 8/1937 Steele ..... B02C 19/0012 241/134
2,468,321 A 4/1949 Bland
2,991,946 A 7/1961 Croft
3,055,597 A 9/1962 Mund
3,078,049 A 2/1963 Hardinge
3,341,134 A * 9/1967 Meloy ..... B02C 19/0012 241/171
3,647,150 A 3/1972 Stephanek
4,065,061 A * 12/1977 Bombled ..... B02C 19/00 241/171
4,508,564 A 4/1985 Kennedy
4,592,516 A 6/1986 Tschantz
4,598,875 A * 7/1986 Bronson ..... B02C 23/12 241/101.76
4,648,560 A 3/1987 Rolle et al.
8,302,890 B2 * 11/2012 Lewis-Gray ..... B02C 21/02 241/101.71
2010/0193618 A1 8/2010 Lewis-Gray

OTHER PUBLICATIONS

"FLEXOWELL(R)-belts for safe and efficient steep inclined and vertical conveying", Conveyor Belt Group, Moers, Germany, 2013.
"Grizzly Feeder" from a Google image search, shown at "http://www.google.ca/imgres?imgurl=http://www.hewittrobins.co.uk/French/Img/products/Grizzly-Feeder2_lg.jpg&imgrefurl=http://www.hewittrobins.co.uk/French/grizzly_feeders.asp&h=359&w=500&sz=61&tbnid=sIVPdKuHZK8zCM:&tbnh=95&tbnw=133&zoom=1&usg=_uB6dwKl1owYtYqdcd5MApOtOPWQ=&docid=gScBUrTVspmHOM&sa=X&ei=lqWPUrj0l4ugqQGjjoDwCQ&ved=0CC8Q9QEwAg", date seen on web: Nov. 22, 2013.
Undated photos of tumbling grinding mills.

* cited by examiner

IMPACT GRINDING PLANT FOR THE COMMUNITION OF ORE

FIELD OF THE INVENTION

There is provided an impact grinding plant. In particular, there is provided an impact grinding plant for the communition of ore.

DESCRIPTION OF THE RELATED ART

Communition of ore in the mining industry is most commonly performed by tumbling mills. These are typically in the form of ball mills, semi-autogenous grinding mills, or autogenous mills. A ball mill is a cylindrical vessel charged with metal grinding balls. Ore is introduced to the mill as it rotates. The balls and ore particles collide with each other to cause size reduction. This motion can be characterized as collision with breakage induced primarily by impact or as rolling with breakage induced primarily by crushing and attrition. Autogenous mills typically have larger diameters than ball mills, causing the material to be dropped from a greater height. Size reduction in an autogenous mill occurs due to direct collisions between ore particles. A semi autogenous mill, often referred to as a SAG mill, operates in a manner similar to an autogenous mill, except that some metal balls are introduced to assist the grinding process. The existing technology used for tumbling has changed little in recent years, other than, for example, increases in the size of the mills.

An alternate grinding technology starting to grow in popularity is the use of high pressure grinding rolls, often referred to as HPGRs. HPGR mills consist of two rollers of the same dimensions, rotating against each other with the same rotational velocity. Bulk material is ground as it is fed between the two rollers which are pressed against the material by springs or hydraulic cylinders. These mills may not have yet demonstrated significant improvement over tumbling mills.

A number of other grinding technologies exist such as tower mills or ISA mills. However these are typically specialized for grinding specific materials, high fineness or small volumes, and may not be suited for the large volumes necessary for industrial mineral processing facilities.

Communition, or size reduction of particulate material is an extremely energy intensive process. Some estimates suggest that communition consumes 3-6% of all electricity generated worldwide. Much of this energy is expended in mining and mineral processing. Grinding, or the process of reducing particles to a size small enough to perform common mineral processing functions, is one of the most important communition processes. Unfortunately the energy efficiency of grinding remains low. Tumbling mills, the most common method of grinding in mineral processing typically only apply 25% of consumed energy to break particles. The remainder is lost as heat, noise or friction. It is therefore highly desirable to increase the energy efficiency of grinding.

Grinding typically occurs in two modes. In impact grinding, a moving particle impacts a hard surface and breaks into smaller particles. In abrasive grinding, the motion of moving particles in contact with each other causes them to break apart. Impact grinding is more efficient due to greater incidence of first impact breakage. First impact breakage refers to particles breaking on initial impact, rather than after repeated impacts. In abrasive grinding, particles typically require multiple impacts before particles break, which typically consumes more energy.

In tumbling mills, particle impact velocities have been increased in recent years by increasing the diameters of mills, particularly the diameters of semi-autogenous grinding (SAG) mills. A larger diameter causes particles to fall from a greater height, undergoing longer acceleration and therefore impacting at a higher velocity. However tumbling mills are possibly approaching the maximum diameter that can be practically fabricated, moved and installed. Indeed, the largest mills may now reach twelve meters in diameter, a size comparable to a four story apartment building. The technical challenges in constructing even larger mills, moving them, installing them and putting them into rotating operation are significant. Fabricating, transporting and installing large tumbling mills is difficult and requires a significant amount of specialized transport and construction equipment.

Charge participation can increase grinding efficiency and it refers to the percentage of material that is impacted with each rotation of the mill. Tumbling mills may not achieve full charge participation as some percentage of material is not lifted, or insufficiently lifted during each rotation.

Tumbling mills may also suffer from overgrinding, which is the term for particles that are ground smaller than desired before exiting the mill. Overgrinding can occur in tumbling mills due to the physical mechanics of tumbling, and reduces the energy efficiency of the mill. Also, a component of energy in tumbling mills is required to overcoming inter-particle rotational friction and abrasive grinding.

Tumbling mills may further require replaceable mill liners to protect the mill wall from the impact of the particles and balls. These must be regularly replaced, requiring the mill to intermittently stop operation.

Lastly, it may be difficult if not impossible to protect tumbling mills from chemical corrosion when processing corrosive ore.

There is accordingly a need for a more cost-effective and efficient means of grinding ore.

BRIEF SUMMARY OF INVENTION

There is provided an impact grinding plant disclosed herein that overcomes the above disadvantages. It is an object herein to improve grinding efficiency, with further goals to reduce initial capital cost while improving constructability and ease of operation.

There is accordingly provided an impact grinding assembly. The assembly includes an impact plate upon which unground material operatively impacts. The assembly includes a vibratory mechanism operatively connected to the impact plate. The vibratory mechanism causes the impact plate to vibrate. The material so impacted thus moves away from the impact plate thereafter.

There is further provided an impact grinding plant. The plant includes a plurality of the impact grinding assemblies as set out above. Each assembly further includes a conveyor for elevating the unground material. Each assembly also includes a separation assembly for separating out ground material and operatively returning still unground material to the conveyor for impacting with its corresponding impact plate again. The plant further has a feeder assembly which selectively conveys unground material to respective ones of the conveyors of the impact grinding assemblies.

There is also provided an impact grinding assembly that includes a pair of conveyors for conveying at least partially unground material. Each conveyor has a lower portion and an upper portion which is spaced-apart above its lower portion. The assembly includes a pair of vibrating impact plates aligning below the upper portions of respective ones of the conveyors to receive the at least partially unground material. A first one of the impact plates operatively directs material thereon to the lower portion of a second one of the conveyors. A second one of the impact plates operatively directs material thereon to the lower portion of a first one of the conveyors.

There is yet further provided a method of impact grinding. The method includes elevating unground material via a conveyor. The method includes dropping the material onto a vibrating impact surface such that 15 to 25% of the material is ground to a particle size no greater than a desired particle size. The method includes separating out the material that has the particle size no greater than the desired particle size. The method includes returning the rest of the material back to the conveyor to be dropped again.

There is yet also provided an impact grinding assembly which includes a means for conveying unground material to a drop zone. The assembly includes a means for impact grinding the unground material. The assembly includes a means for separating out fully ground material from the material so impacted and returning the rest of the material back to the means for conveying.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
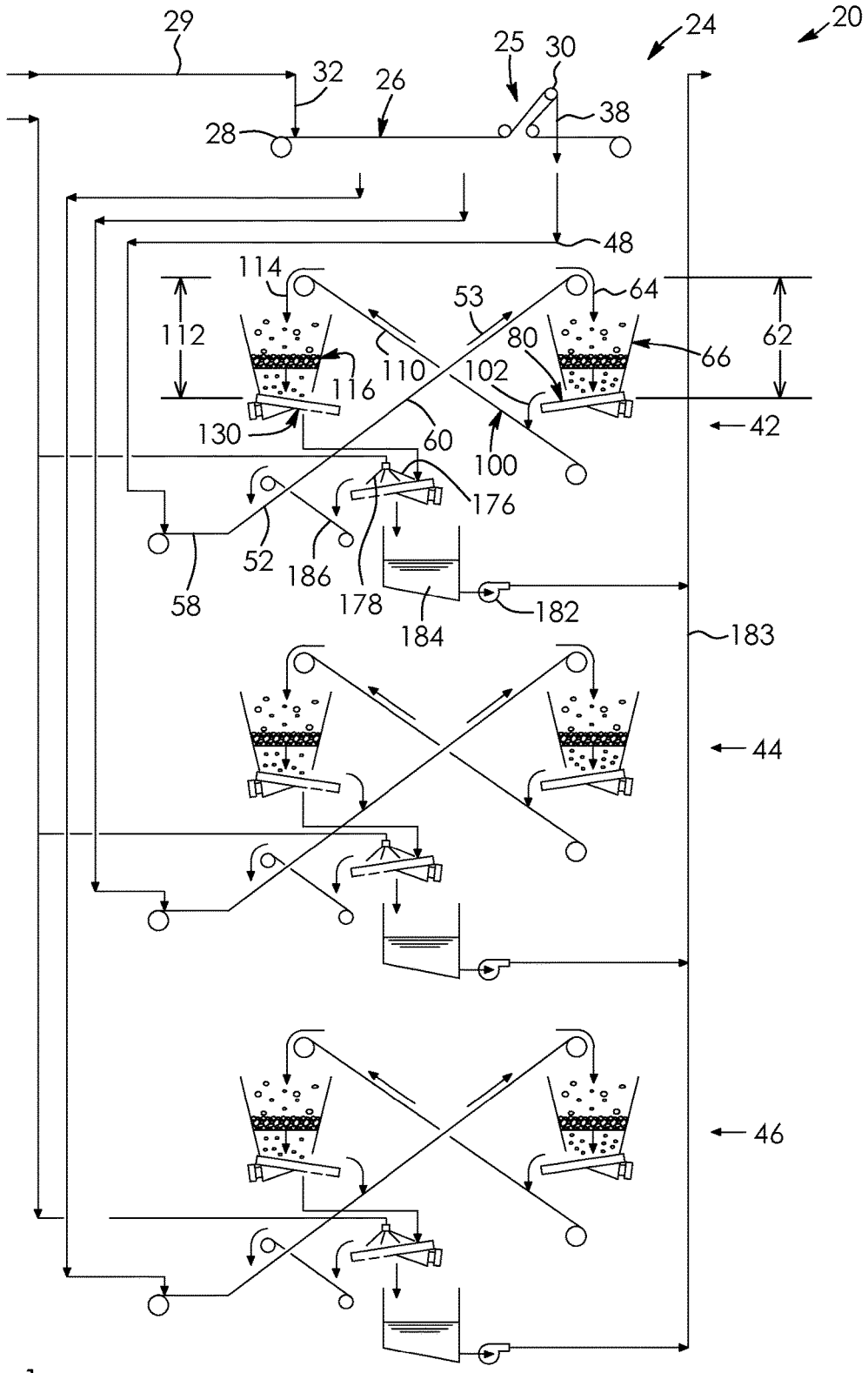
FIG. 1 is a schematic flow chart of an impact grinding plant according to a first aspect, the impact grinding plant including a feeder assembly and a plurality of impact grinding assemblies.
Figure 7:
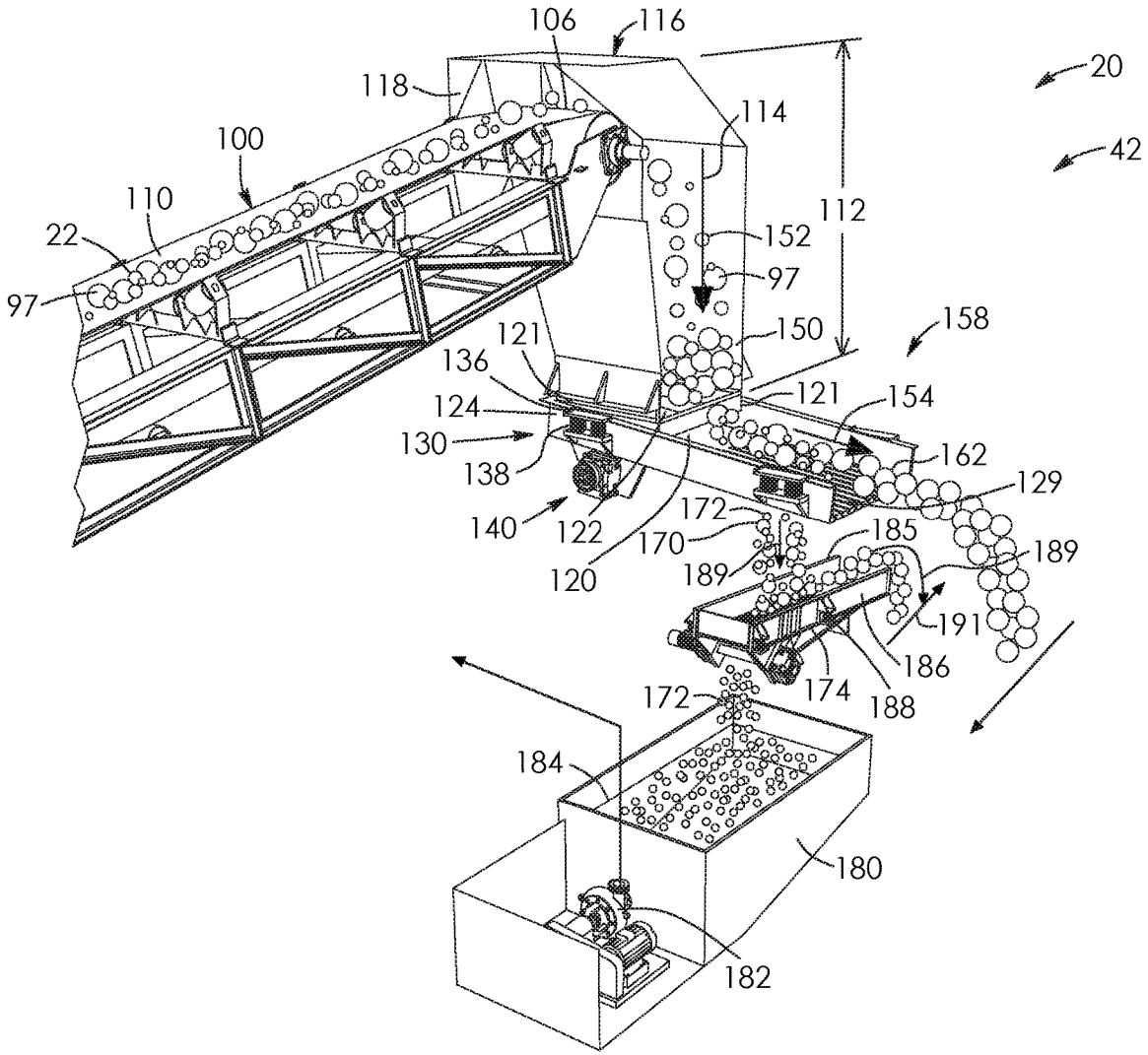
FIG. 7 is a side perspective view of a conveyor shown in fragment, a drop chute partially shown in fragment to reveal its interior, a vibratory grizzly feeder having an impact plate, and a separation assembly for the impact grinding assembly of FIG. 5.

Referring to the drawings and first to FIG. 1, there is shown an impact grinding plant 20 for grinding at least partially unground material, in this example ore 22 as seen in FIG. 7. In this case, the plant performs communition of the ore to reduce the particle size of crushed ore sufficiently so that other mining processes can subsequently be used to separate the valuable ore from the gangue, or the commercially valueless material.

Figure 2:
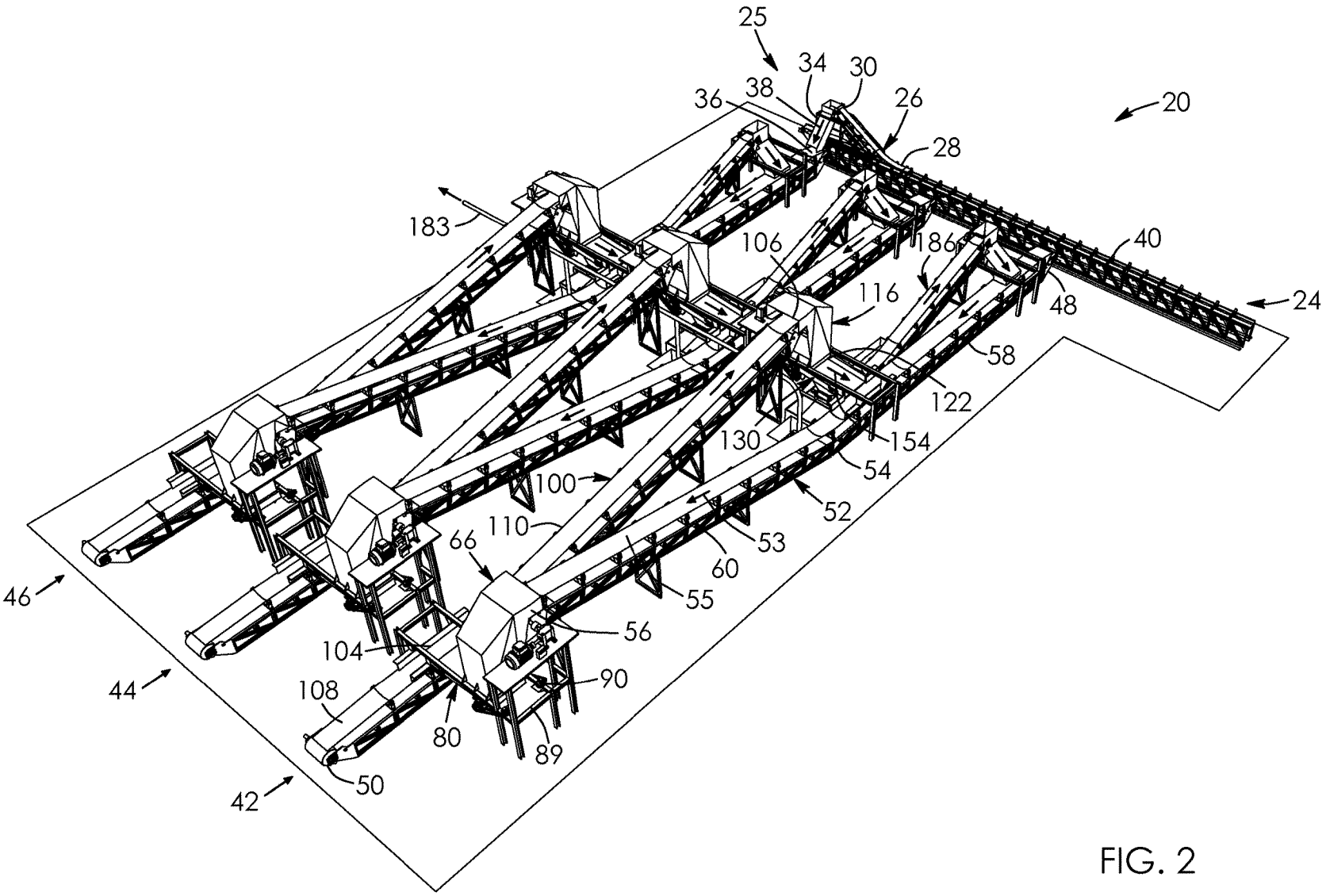
FIG. 2 is a perspective view of the impact grinding plant of FIG. 1.

Referring to FIGS. 1 and 2, the plant 20 includes a feeder circuit or assembly 24. The feeder assembly includes a moveable cart 25 in this example. The cart includes a feeder conveyor 26 that draws material, such as a crushed ore, from an external source such as a stockpile. The conveyor has a lower end 28 upon which unground material may be deposited, as seen by arrows 29 and 32 in FIG. 1. The conveyor has an upper end 30 which is spaced-apart above its lower end. The conveyor 26 includes a belt conveyor in this example, though this is not strictly required. The conveyor extends in a generally diagonal direction from its lower end to its upper end in this example.

The conveyors shown in FIGS. 1 to 8 as herein described are in the form of endless loop belt conveyors in this example. Belts conveyors per se, including their various parts and functionings, are well known to those skilled in the art and therefore will be not be described in further detail. Also, belt conveyors are not strictly required and other types of conveyors can be used.

As seen in FIG. 2, the moveable cart 25 includes a chute 34 which is in communication with the upper end 30 of conveyor 26. The chute is generally in the shape of a hollow, rectangular prism which is rectangular in cross-section in this example. The chute 34 is shaped to downwardly direct unground material, conveyed upwards by the conveyor, to an outlet 36, as shown by arrow 38. The conveyor 26 may be selectively activated to feed unground material through the chute.

The cart 25 is linearly moveable along an elongate structure, in this example along conveyor rails 40. Moveable carts, chutes and rails per se, including their various parts and functionings, are well known to those skilled in the art and therefore will not be described in further detail.

As seen in FIG. 2, the plant 20 includes a plurality of impact grinding circuits or assemblies 42, 44, and 46. The impact grinding assemblies extend in a generally elongate manner in this example and are aligned in parallel with each other in this example. The feeder assembly 24 is adjacent to and aligns substantially perpendicular to the impact grinding assemblies 42, 44 and 46 in this example. Cart 25 is moveable in a direction transverse to the impact grinding assemblies for selectively feeding unground material in an alternating manner to respective ones of the impact grinding assemblies at different times.

Figure 5:
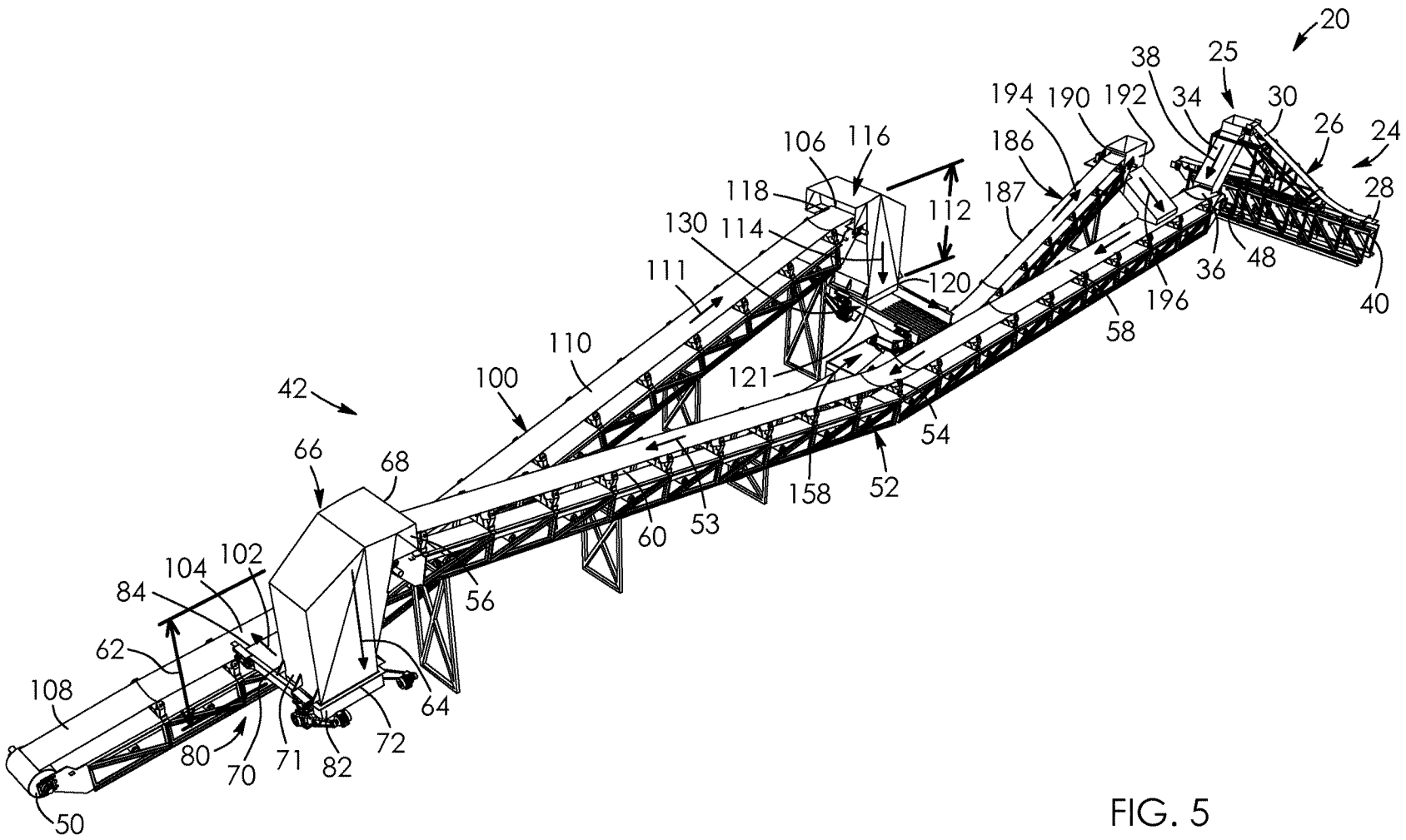
FIG. 5 is a perspective view of one of the impact grinding assemblies of the impact grinding plant of FIG. 2, together with the feeder assembly shown in fragment.

Referring to FIG. 5, impact grinding assembly 42 has a proximal end 48 adjacent to the feeder assembly 24 and a distal end 50 which is spaced-apart from the proximal end. Chute 34 is positioned to direct unground material to respective ones of the impact grinding assemblies at their proximal ends 48. The proximal ends of the assemblies 42, 44 and 46 align with each other and the distal ends 50 of the assemblies 42, 44 and 46 also align with each other in this example.

Each of the impact grinding assemblies 42, 44 and 46 is substantially similar in parts and functionings. Thus, only impact grinding assembly 42 will be discussed in detail with the understanding that the other of the impact grinding assemblies 44 and 46 are substantially the same.

The impact grinding assembly 42 includes a first or send conveyor 52 for elevating unground material, as shown by arrow 53 in FIG. 5. The send conveyor includes an elevating section, in this example an inclined section 60 having a lower end 54 and an upper end 56 which is spaced-apart above its lower end. The lower end 54 corresponds to a lower portion of the conveyor and the upper end 56 corresponds to an upper portion of the conveyor. The inclined section of the conveyor 52 extends diagonally from its lower end to its upper end 56 in this example. The send conveyor 52 also has a substantially horizontal section 58 in this example that extends from proximal end 48 of the assembly 42 to lower end 54 of the inclined section 60 of the conveyor. The horizontal section of the conveyor may receive unground material from the feeder assembly 24.

The impact grinding assembly 42 has a first drop zone 62 within which at least partially unground material drops, as shown by arrow 64 in FIGS. 1 and 5. The drop zone extends in a substantially vertical direction in this example.

The impact grinding assembly 42 has a first drop chute 66 which extends around the drop zone. The chute is substantially in the shape of a rectangular prism which is rectangular in cross-section in this example. The chute has an inlet 68 positioned to receive unground material from the upper end 56 of the inclined portion 60 of conveyor 52. The chute 66 has an outlet 70 at a lower end 71 thereof which is spaced-apart below its inlet.

Figure 6:
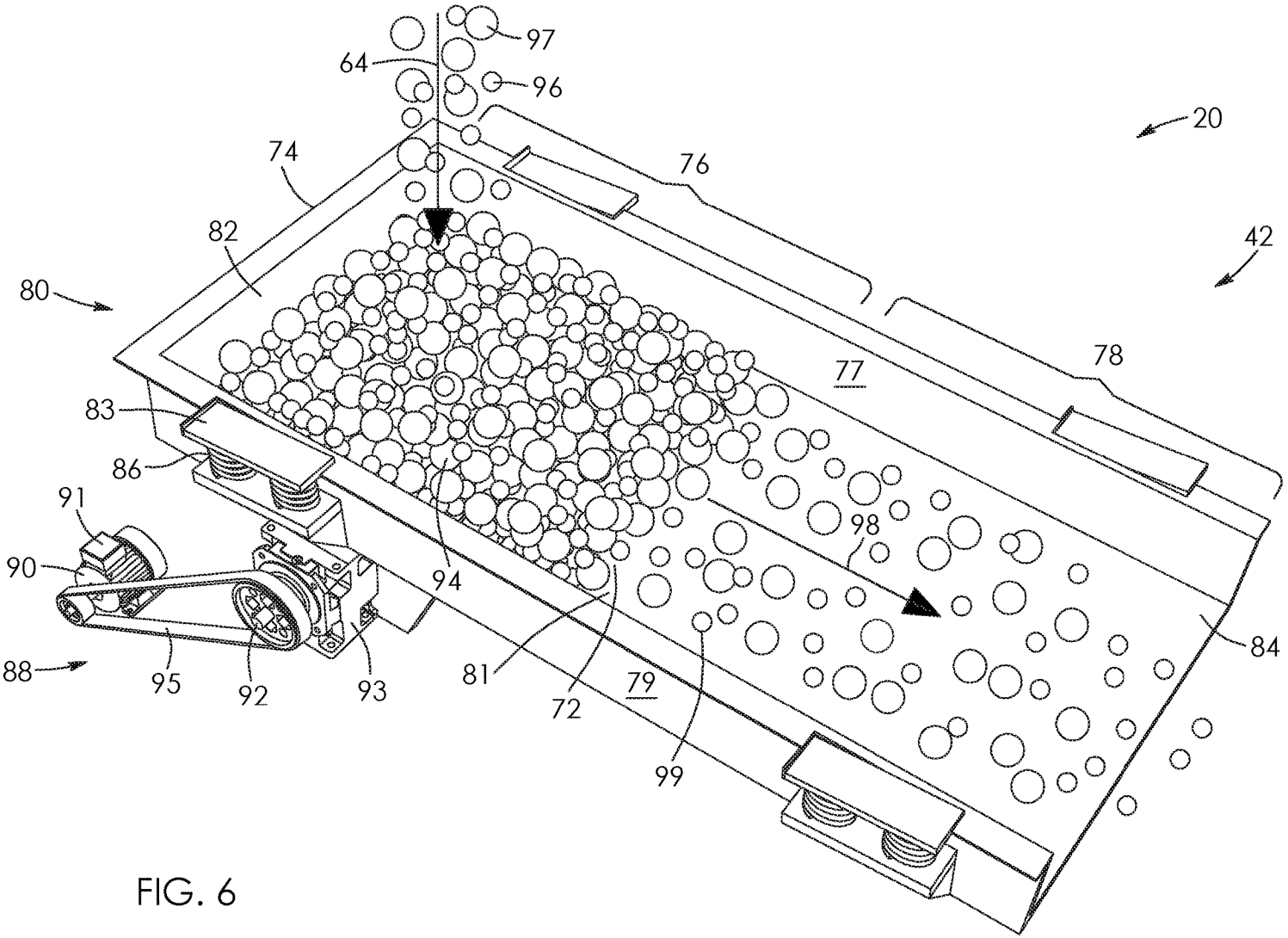
FIG. 6 is a top perspective view of a vibratory pan feeder for the impact grinding assembly of FIG. 5, the vibratory pan feeder including an impact plate.

Referring to FIGS. 5 and 6, the impact grinding assembly 42 includes a first impact surface, in this example in the form of a vibrating impact plate 72 upon which the at least partially unground material operatively impacts after falling from the upper end 56 of conveyor 52. The impact plate aligns below the upper end of the conveyor and the conveyor is thus positioned to drop the at least partially unground material onto the impact plate. The conveyor 52 may be referred to as a means for conveying at least partially unground material to a drop zone. The chute 66 and drop zone 62 extend from the upper end of the inclined section of the conveyor to the impact plate.

Referring to FIG. 6, the assembly 42 also includes a receptacle 74 of which the impact plate 72 forms a first portion or half 76 thereof. The receptacle is hollow, with an open top and is generally rectangular in shape in this example. The receptacle 74 includes a second portion or half 78 connected to and extending from its first half.

Still referring to FIG. 6, the assembly 42 includes a vibratory pan feeder 80 in this example of which the receptacle 74 and impact plate 72 are parts. As seen in FIG. 6, the feeder has a closed end 82 adjacent to the impact plate and adjacent to a position where the at least partially unground material is received. The feeder also has an open end 84 which is spaced-apart from its closed end. The feeder 80 further includes a pair of spaced-apart side walls 77 and 79 that extend from end 82 to end 84 thereof.

The impact plate 72 and vibratory feeder 80 extend in a substantially horizontal direction in this example, with the closed end 82 of the feeder 80 being only slightly elevated relative to open end 84 of the feeder to enable material adjacent to end 82 to move via the feeder's vibration and gravity towards end 84. The feeder 80 includes a wear liner 81 that extends from end 82 to 84 in this example. Referring to FIG. 6, outwardly-extending flanges 83 of the feeder extend from respective side walls 77 and 79 thereof. The flanges connect to the lower end 71 of the chute 66, seen in FIG. 5. Flanges 83 connect to the receptacle 74 via a plurality of springs 86 seen in FIG. 6.

The conveyors, chutes, feeders, separations assemblies and the like as described herein are supported by conventional framing, as generally shown by numeral 89 in FIG. 2, in this example in this form of metal frames and trusses.

Referring to FIG. 6, the feeder 80 includes a vibratory mechanism 88 operatively connected to the receptacle 74 and thus to the impact plate 72, which causes the impact plate to vibrate. As seen in FIG. 2, the vibratory mechanism in this example includes a motor 90 mounted to framing 89 of the impacting grinding assembly 42. The vibratory mechanism 88 includes an unbalanced shaft 92, in this example, coupled to the motor 90 via an endless belt 95. Housing 93 of the unbalanced shaft is connected to the receptacle 74. The rotation of shaft 92 by motor 90 causes housing 93, and thus feeder 80 to selectively vibrate.

The vibratory mechanism 88 causes a bed of material 94 to form above the impact plate 72 and onto which further at least partially unground material 96 impacts. The term "operatively impacts" is used herein to refer to the fact that falling material may collide with the impact plate 72 merely indirectly, because the falling material may directly impact the bed of material 94, which in turn may be abutting the impact plate. In this case, the assembly 42 includes a control system 91, seen in FIG. 6, operatively in communication with motor 90 and which sends signals thereto maintain the bed of previously dropped particles by controlling the feeder's vibration rate. A portion of the dropped material breaks upon impact. In this embodiment, assembly 42 includes a plurality of mill balls, in this example metal balls 97, as seen in FIGS. 6 and 7, that move along conveyor 52, seen in FIG. 5, and drop onto the bed of material 94, further creating at least partially ground material. Balls 97 may assist in the breakage of particles. Additional abrasive grinding may occur due to the vibrating action of the feeder.

Selectively adjusting the extent of vibration of feeder 80 enables the thickness of the bed of material 94 to be tailored as desired. Material 99 and balls 97 within the feeder are thereafter moved away from the impact plate 72, as shown by arrow 98 in FIG. 6, also based at least in part on the extent to which the feeder 80 is vibrated.

Figure 3:
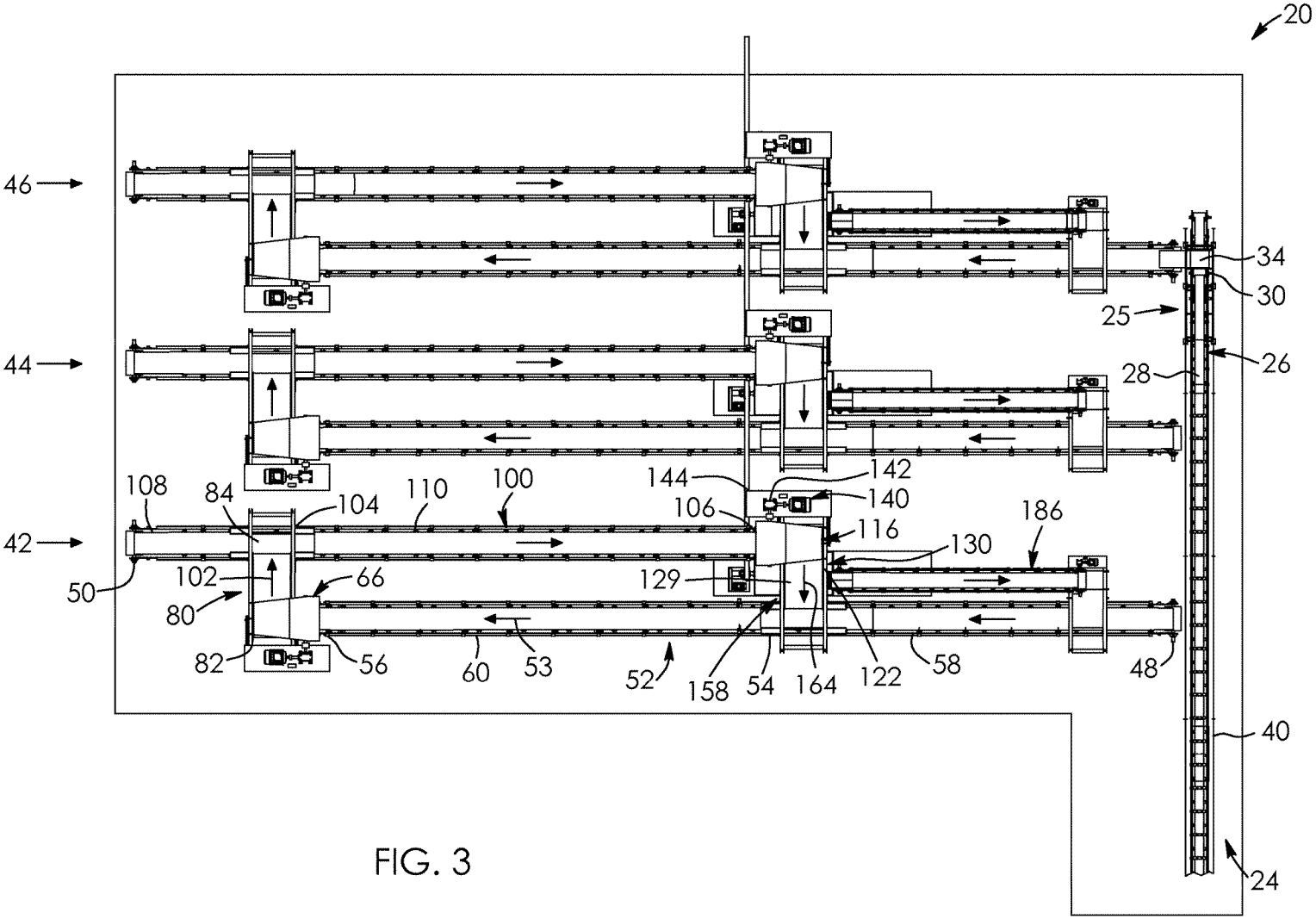
FIG. 3 is a top plan view of the impact grinding plant of FIG. 2.

The impact grinding assembly 42 includes a second or return conveyor 100 for elevating material exiting from feeder 80, as shown by arrow 102 in FIG. 3. The return conveyor 100 includes an elevating section, in this example an inclined section 110. The inclined section of the conveyor 100 includes a lower end 104 and an upper end 106 which is spaced-apart above its lower end. The lower end 104 corresponds to a lower portion of the conveyor and the upper end 106 corresponds to an upper portion of the conveyor. The inclined section 110 in this example extends diagonally from its lower end 104 to its upper end 106.

Lower end 104 of the inclined section of the conveyor 100 aligns with and is adjacent to the open end 84 of the feeder 80 for receiving material therefrom. Lower end 104 substantially aligns with impact plate 72 seen in FIG. 6. Impact plate 72 thus operatively directs material thereon to the lower end 104 of conveyor 100. The vibrator energy of feeder 80 conveys material at a constant rate to conveyor 100 seen in FIG. 4.

The return conveyor 100 has a substantially horizontal section 108 in this example that extends from distal end 50 of the assembly 42 to the lower end 104 of the inclined section 110 of the conveyor. The horizontal section of the conveyor receives material exiting from the feeder 80 in this example. The inclined sections 60 and 110 of conveyors 52 and 100, respectively, are inclined in opposite directions in this example, in a criss-crossing arrangement.

As seen in FIG. 5, the lower end 104 of the inclined section 110 of the conveyor 100 aligns with and is spaced-apart below the upper end 56 of the inclined section of the conveyor 52. Upper end 106 aligns with and is spaced-apart above the lower end 54 of the inclined section 60 of conveyor 52. The lower ends 54 and 104 of the inclined sections of conveyors 52 and 100, respectively, substantially align within the same horizontal plane and are at substantially the same elevation in this example. The upper ends 56 and 106 of the inclined sections of the conveyors 52 and 100, respectively, also substantially within the same horizontal plane and are at substantially the same elevation in this example.

The material, now consisting of a mixture of unground material, metal balls, intermediate-sized material, and ground material, is conveyed by the return conveyor 100, in a direction opposite to the direction of movement of send conveyor 52 in this example, as shown by arrow 111 in FIG. 5. The ground material has a particle size no greater than a desired particle size.

The impact grinding assembly 42 includes a second drop zone 112 within which at least partially unground material drops, as shown by arrow 114 in FIGS. 1, 5 and 7. The drop zone extends in a substantially vertical direction in this example. The assembly 42 further includes a second drop chute 116 which extends around drop zone 112. The chute is substantially in the shape of a rectangular prism which is rectangular in cross-section in this example. The chute has an inlet 118 positioned to receive at least partially ground material from the upper end 106 of the inclined section of the conveyor 100. The chute 116 has an outlet 120 at a lower end 121 thereof which is spaced-apart below its inlet.

Figure 8:
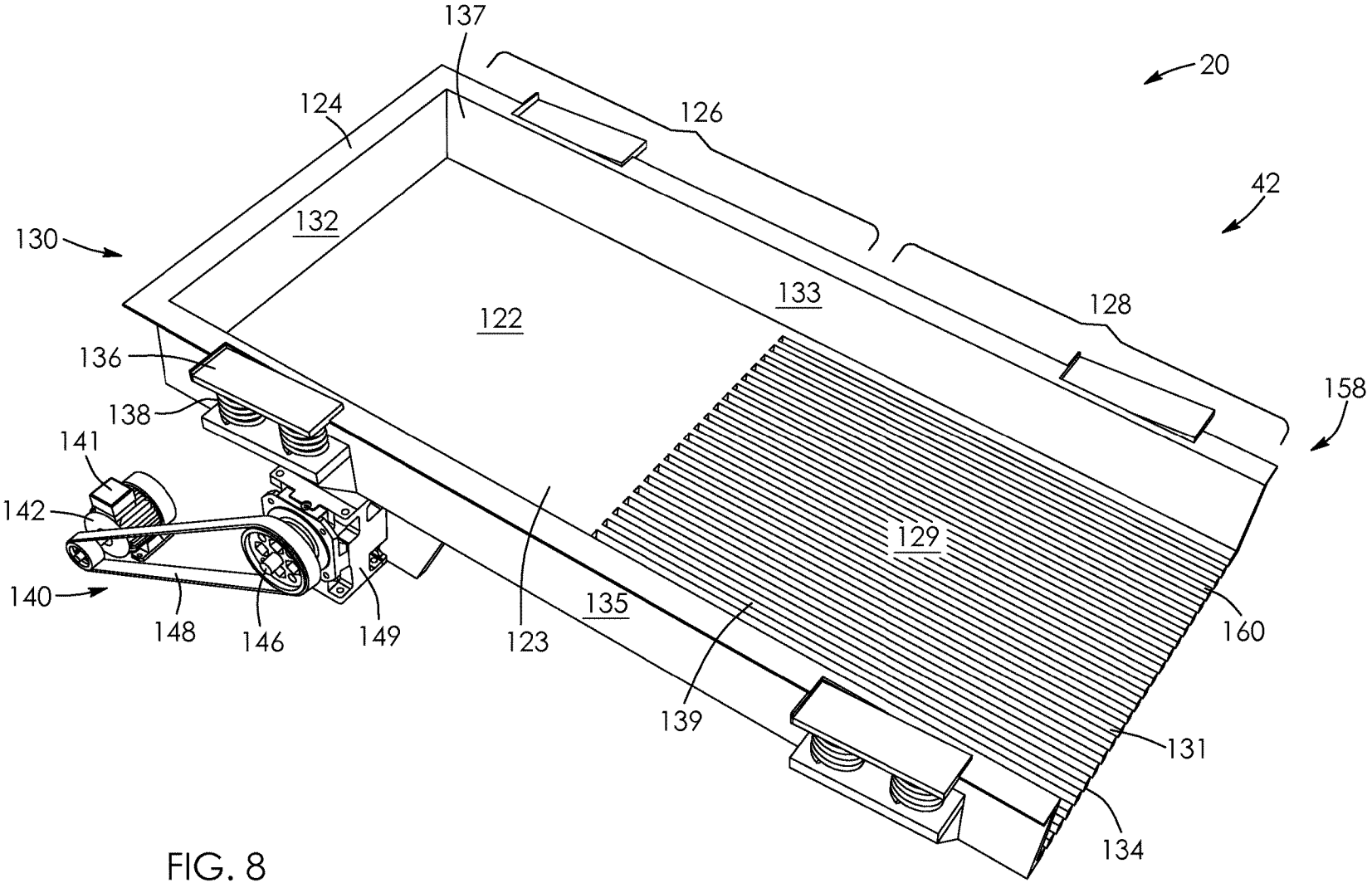
FIG. 8 is a top perspective view of the vibratory grizzly feeder and impact plate of FIG. 7.

Referring to FIGS. 7 and 8, the impact grinding assembly 42 includes a second impact surface, in this example in the form of a vibrating impact plate 122. Upon reaching end 106 of the inclined portion 110 of conveyor 100, material falls through the chute 116 to operatively impact the impact plate. The impact plate 122 aligns below the upper end of the inclined section of the conveyor and the conveyor is thus positioned to drop the at least partially unground material onto the impact plate. Impact plate 122 extends in a substantially horizontal direction in this example and is substantially level with the lower end 54 of the inclined section 60 of conveyor 52 seen in FIG. 5. As seen in FIGS. 2 and 3, lower end 54 substantially aligns with impact plate 122. Referring to FIG. 7, the chute 116 and drop zone 112 extend from the upper end 106 of the inclined section of the conveyor to the impact plate 122.

Figure 4:
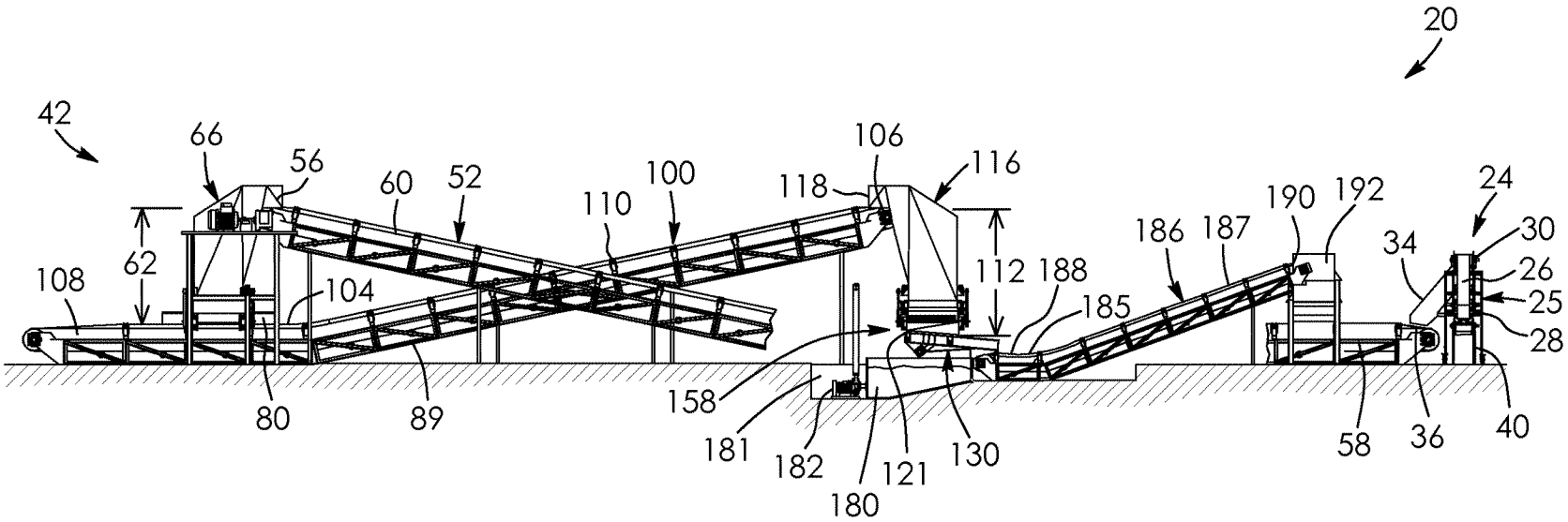
FIG. 4 is a side elevation view of the impact grinding plant of FIG. 2.

Referring to FIG. 4, the drop zone 62 and impact plate 72 seen in FIG. 6 and the drop zone 112 and impact plate 122 seen in FIG. 7, respectively, may be referred to individually or collectively as a means for impact grinding at least partially unground material.

As seen in FIG. 8, the assembly 42 includes a receptacle 124 of which the impact plate 122 forms a first portion or half 126 thereof. The receptacle is generally rectangular in shape in this example and includes a second portion or half 128 connected to and extends from its first half. The second portion of the receptacle comprises a material-separation grid 129. The material-separation grid is thus positioned adjacent to impact plate 122.

The assembly 42 includes a vibratory feeder, in this example a vibratory grizzly feeder 130 of which the receptacle 124, impact plate 122 and material-separation grid 129 are parts. The impact plate includes a wear liner 123 which extends overtop thereof in this example. Feeder 130 may be referred to as a combined impact surface and grizzly feeder.

As seen in FIG. 8, the feeder has a closed end 132 adjacent to the impact plate and adjacent to a position where the at least partially unground material is received. The feeder has an open end 134 which is spaced-apart from its closed end. As seen in FIG. 8, the feeder 130 has a pair of spaced-apart side walls 133 and 135 that extend from end 132 to end 134. The impact plate 122 and vibratory feeder extend in a substantially horizontal direction in this example, with the closed end 132 of the feeder 130 being only slightly elevated relative to open end 134 of the feeder to enable material adjacent to end 132 to move via the feeder's vibration and gravity towards end 134. Outwardly-extending flanges 136 of the feeder extend from walls 133 and 135, respectively. In this example, the flanges connect to the lower end 121 of the chute 116, seen in FIG. 7. Flanges 136 connect to the receptacle 124 via a plurality of springs 138 seen in FIG. 8.

Current grizzly feeders may devote the majority of their surface area to grizzly rods or bars, which are used to separate large and small pieces of material, aided by vibratory motion. By contrast, a significant area of feeder 130 is devoted to provide a bed and impact area 137, corresponding to half 126 of receptacle 124 and within which is impact plate 122 for falling material. This area is substantially rectangular in shape, bounded by closed end 132 and parts of side walls 133 and 135, of a distance approximating the feeder's width. A second adjacent area 139, corresponding to half 128 of receptacle, which is similar in size to area 137, is devoted to grizzly bars and material separation, as described below. Feeder 130 therefore may perform three functions simultaneously, namely, providing an impact surface for falling material, feeding material forward through vibratory motion, and size-separating material through the material-separation grid 129.

The feeder 130 includes a vibratory mechanism 140 operatively connected to the receptacle 124 and thus the impact plate 122, which causes the impact plate to vibrate. As seen in FIG. 3, the vibratory mechanism in this example includes a motor 142 mounted to framing 144 of the impacting grinding assembly 42. Referring back to FIG. 8, the vibratory mechanism 140 includes an unbalanced shaft 146, in this example, coupled to the motor 142 via an endless belt 148. Housing 149 of unbalanced shaft 146 is connected to the receptacle 124. The rotation of shaft 146 by motor 142 causes housing 149, and thus feeder 130 to selectively vibrate.

Referring to FIG. 7, the vibratory mechanism 140 causes a bed of material 150 to form above the impact plate 122 and onto which further at least partially unground material 152 and metal balls 97 operatively impact. Selectively adjusting the extent of vibration of feeder 130 enables the thickness of the bed of material 150 to be tailored as desired. In this case, the assembly 42 includes a control system 141, seen in FIG. 8, operatively in communication with motor 142, which sends signals thereto to maintain the bed of previously dropped particles by controlling the feeder's vibration rate. A portion of the dropped material breaks upon impact. Balls 97 may assist in the breakage of particles. Additional abrasive grinding may occur due to the vibrating action of the feeder.

Material and balls within the feeder thereafter are moved away from the impact plate 122 thereafter, as shown by arrow 154 in FIG. 7, also based at least in part on the extent to which the feeder 130 is vibrated.

As best seen in FIG. 7, the impact grinding assembly 42 includes a material separation assembly 158 for separating out ground material and returning still unground material to conveyor 52 for impacting in the drop zones 62 and 112 again, as seen in FIG. 4. This assembly 158 may be referred to as a means for separating out fully ground material from the material so impacted and returning the rest of the material back to the means for conveying. Referring back to FIG. 8, the material separation assembly is interposed between impact plate 122 and horizontal section 58 of conveyor 52 seen in FIG. 2.

As seen in FIG. 7, the material separation assembly 158 includes the material-separation grid 129 of the grizzly feeder 130. The grid comprises a plurality of elongate, spaced-apart bars 160 in this example that extend from end 134 of the feeder 130 towards end 132 of the feeder. The bars are spaced-apart so as to inhibit metal balls 97 and oversized material 162 from passing therethrough. Thus, material exiting chute 116 crosses a number of horizontal slots 131 positioned between the grids, seen in FIG. 8, of the feeder 130 and the size of the slots is selected such that the metal balls and large unground particles cannot pass therethrough.

The balls and large unground particles are conveyed via the vibration of the grizzly feeder and gravity away from grid 129. The vibrator energy of feeder 130 conveys material at a constant rate to conveyor 52 seen in FIG. 4 in this example. This material is returned to the conveyors 52 and 100 for impacting within the drop zones 62 and 112 again, as seen in FIG. 4. The metal balls are thus separated from the at least partially ground material and returned to conveyor 52 via the material-separation grid 129 as seen in FIG. 7. In this manner, this material fraction of balls and oversized material is returned to the grinding circuit for further grinding.

Referring back to FIG. 7, the material-separation grid 129 allows at least partially ground material 166 to be removed from the conveyors via gravity, as shown by arrow 168, where further size separation occurs. The at least partially ground material 166 comprises intermediate sized material 170 and fully ground material 172.

The material separation assembly 158 includes a product screen 174 positioned below the material-separation grid 129 and through which the fully ground material 172 passes. Openings in the product screen are thus sized to allow fully ground material to pass through. The assembly 158 includes a water spray header 176, seen in FIG. 1, through which water 178 sprays to assist in product separation. Referring to FIG. 7, the impact grinding assembly 42 includes a slurry sump 180 positioned within a recess 181 of the ground in this example, as seen in FIG. 4, below the material separation assembly 158. The assembly 42 also includes a slurry pump 182 operatively connected to the sump. The water 178 and fully ground material 172 form a slurry 184 that collects within the slurry sump. The slurry is pumped to the next stage in the mineral processing facility (not shown) by the slurry pump 182 via a conduit, in this example a single slurry pipe 183 seen in FIG. 2, to which each of the assemblies 42, 44 and 46 is in communication. Water 178 also provides make up water to replace water as it leaves the circuit as slurry.

Referring to FIG. 7, according to one aspect, the percentage by mass flow of material (balls and large rocks) passing over the grizzly feeder 130 to continue circulation on conveyor 52 is 50-90% according to one preferred aspect, 75-85% according to a further preferred aspect, and 80% according to yet a further preferred operating point, in one example. Conveyor 100 may thus be positioned to cause 15-25% of the material operatively colliding with impact plate 122 to be fully ground so as to pass through the material-separation assembly 158, with the impact grinding assembly 42 operatively conveying the rest of the material back to the conveyor 52.

As seen FIGS. 5 and 7, the impact grinding assembly 42 further includes an intermediate conveyor 186 having a horizontal section 185 positioned adjacent to screen 174. The conveyor includes an elevating section, in this example an inclined section 187. Referring to FIG. 5, the inclined section of conveyor 186 has a lower end 188 and an upper end 190 which is spaced-apart above its lower end. The lower end 188 corresponds to a lower portion of the conveyor and upper end 190 corresponds to an upper portion of the conveyor. The horizontal section 185 of the conveyor extends to lower end 190. The elevating section 187 of the conveyor 186 extends diagonally, in this example, from its lower end to its upper end. Lower end 188 aligns with and is positioned adjacent to the lower end 54 of the inclined section 60 of conveyor 52. The upper end 190 of the inclined section of the conveyor 186 is positioned adjacent to the proximal end 48 of the assembly 42.

As seen in FIG. 7, the conveyor 186 receives, adjacent to its lower end, intermediate-sized material 170 which does not pass through the screen, as seen by arrows 189 and 191, and elevates this material upwards, as shown by arrow 194 in FIG. 5.

Still referring to FIG. 5, the assembly 42 further includes a drop chute 192 through which conveyor 186 drops the intermediate-sized material, as shown by arrow 196. The drop chute directs material back onto conveyor 52. In this manner this material fraction is directed back to the conveyors 52 and 100 of the grinding assembly 42 for further grinding.

In summary and referring to FIG. 2, once material to be ground is introduced to the assembly 42, it will continue in an endless circuit comprising conveyor 52, chute 66, vibratory pan feeder 80, conveyor 100, chute 116, grizzly feeder 130, and back to conveyor 52. Particles have no means of leaving the assembly other than ultimately having their size reduced through one or more falling impacts in the drop zones. Once a particle's size is reduced sufficiently to pass through the slots in the grizzly feeder 130, and then the product screen 174 seen in FIG. 7, the fully ground material exits the assembly 42. The system's final product is slurry 184, seen in FIG. 1, containing fully ground product and which may be pumped to the next stage in the mineral processing facility. The moveable cart 25 seen in FIG. 2 alternates from feeding one grinding assembly to the next, feeding the overall plant at a rate that matches the discharge of fully ground product.

The metal balls 97 may be optionally used to aid the grinding process and are not strictly required. If metal balls are utilized, they may be manually introduced to conveyors 52 and 100 before the assembly 42 is started according to one example. They may then remain within the assembly 42 indefinitely or until they are replaced due to wear.

Unground material and metal balls may represent 80% to 90% of the mass circulating in the assembly 42, according to one example. As the lift distance and fall distance of this material fraction are nearly the same, conveying energy is efficiently converted to material breakage. As the intermediate portion of material may only 10%-20% percent of the circulating mass according to one example, the additional energy requirements of the intermediate recirculation conveyor may not significantly impact the overall system efficiency.

Wear liners 81 and 123 on the feeders 80 and 130, seen in FIGS. 6 and 8, may require occasional replacement, as may belts on the conveyors, as shown by belt 55 for conveyor 52 in FIG. 2. In these circumstances only one of the three or more assemblies 42, 44 and 46 needs to be shut down at a given time, allowing the grinding plant 20 to otherwise continue in operation.

The control systems 91 and 141, shown by way of example only in FIGS. 6 and 8, ensure that the mass of material fed into the plant 20 does not exceed the mass of material leaving the plant. This thereby inhibits a buildup of material within the impact grinding assemblies 42, 44 and 46. The control systems may also proportion make up water addition with rate of production of fully ground product to ensure a consistent and pumpable slurry discharging from the system.

Many advantages may result from the structure of the present invention. The plant 20 and assemblies described herein may provide a number of means of increasing grinding efficiency compared to prior known grinding systems. For example, the present invention may increase the velocity of impact of materials during impact grinding. The present invention may achieve this end and overcome the size limitation of tumblers by elevating material linearly using low friction conveyors. With this innovation, greater particle drop heights may be readily achieved. This may result in correspondingly higher impact velocities, higher frequency of first impact breakage and thus higher grinding efficiency. To provide further efficient grinding, large particles and grinding balls (90% of the weight in a semi-autogenous grinding mill) may fall a distance substantially similar to the height lifted, maximizing energy efficiency thereby.

Also, the plant 20 and associated assemblies described herein may increase charge participation, compared to conventional grinding systems, by providing one hundred percent charge participation. This is because all material is fully elevated and impacted during each passage through the grinding assemblies. This may increase the energy efficiency of the present invention, in comparison to tumbling mills.

Furthermore, the plant 20 and associated assemblies described herein maximize expended energy on impact breakage in lieu of abrasive breakage. This is because, in comparison to tumbling mills, the present invention primarily devotes consumed energy to raising and dropping particles due to its physical configuration. Therefore most grinding occurs using impact breakage. As impact breakage is more energy efficient than abrasive breakage, this may further increase the energy efficiency of the present invention, when compared to tumbling mills.

Further energy savings result by the plant 20 and associated assemblies described herein reducing overgrinding. This is achieved by passing all material repeatedly through sizing and screening stages which remove adequately ground material from the circuit before it can be overground, or excessively ground.

Tumbling mills may not able to take full advantage of the above set out improvements due to limitations resulting from their rotational geometry. The present invention may not experience these limitations and may therefore offers greater grinding efficiency.

Yet further energy savings may be provided by the plant and associated assemblies described herein by reducing or inhibiting slurry pooling. Slurry pooling occurs when excessive liquid builds up in a tumbling mill which lessens the impact received by of dropped particles. In the current invention, the potential for efficiency reduction due to slurry pooling is reduced and/or essentially eliminated as the grinding chamber is not sufficiently enclosed to contain a buildup of liquid.

In the present invention, according to one aspect, the plant is configured so that particles impact a bed of previously dropped material. This may both maximize grinding efficiency and prevent rapid and destructive wear to the metal surface of the liner/impact plate(s). The present invention may thus require significantly fewer liners. These liners may be less costly and easier to replace because they can be replaced without requiring a full shutdown of the grinding operation. This may thereby enable the plant to process a relatively large grinding volume. The present invention may further offer a higher operational availability than tumbling mills.

Also, in the current invention, high capacity belt conveyors are utilized, which may have much higher capacities than bucket elevators for example.

A further advantage of this invention is that it is an assembly of common and readily available equipment components. Belt conveyors, vibratory feeders, grizzly feeders and vibrating screens are very common equipment in the mineral processing industry and readily available from a large number of suppliers. This may lower initial capital outlay, lead to faster fabrication and lead to more rapid construction in comparison to tumbling mills. The use of common components may further facilitate ongoing operation and maintenance.

For most applications, the belt conveyors may commonly be fabricated with a carbon steel structure with rubber or elastomeric belts. Feeders and screens may also commonly have carbon steel frames. Liners may be of abrasion resistant metals or energy absorbing elastomerics such as rubber. The present invention can also readily be adapted to processing corrosive materials.

A further advantage of this invention is that it can be readily adapted for use with corrosive ores. In this circumstance conveyor belts and liners would be selected for chemical compatibility with the material to be ground.

Figure 9:
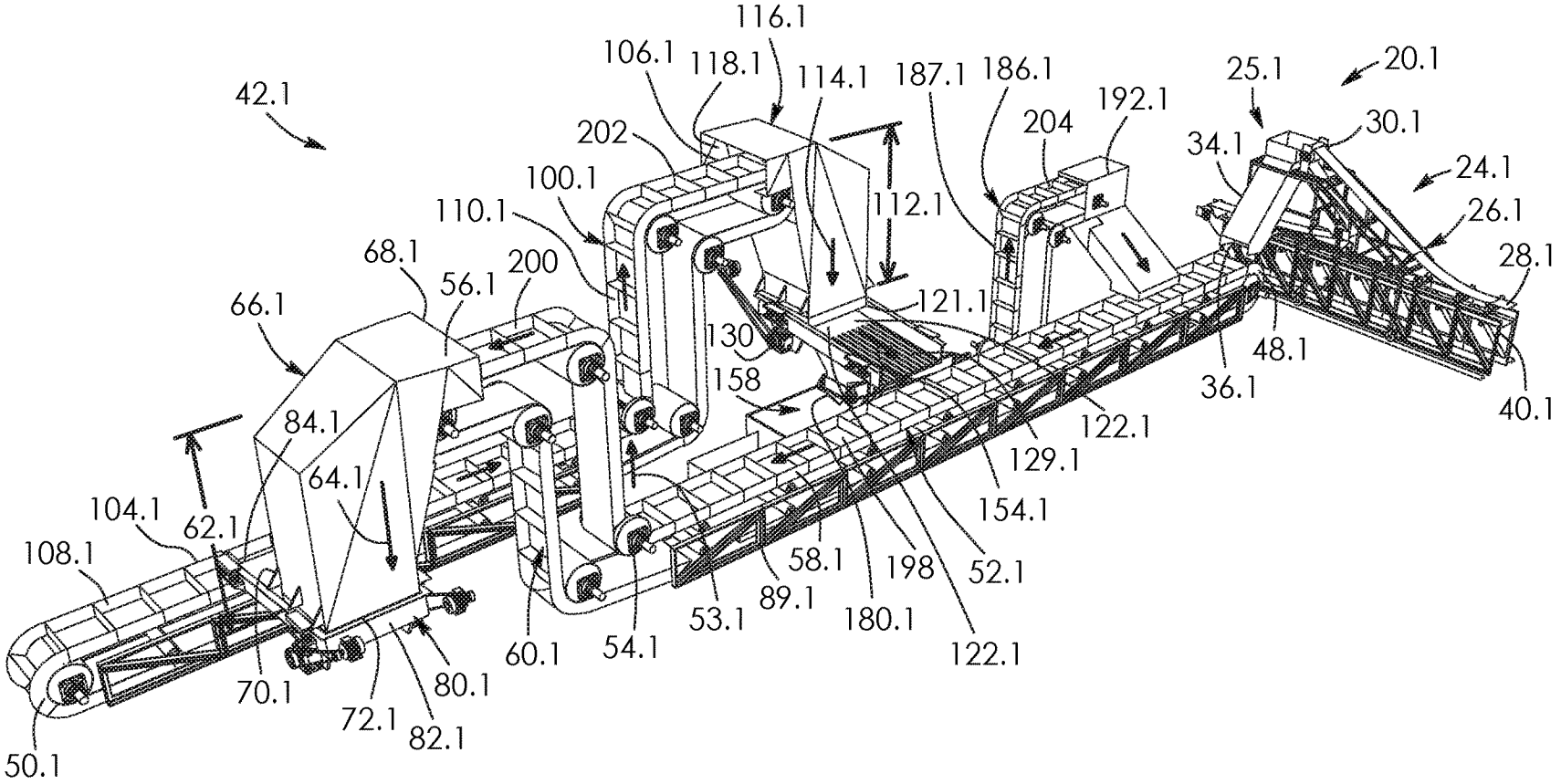
FIG. 9 is a perspective view similar to FIG. 5 of an impact grinding plant according to a second aspect, the plant including an impact grinding assembly and a feeder assembly which is shown in part.

FIG. 9 shows an impact grinding plant 20.1 including at least one impact grinding assembly 42.1 according to a second aspect. Like parts have like numbers and functions as the plant 20 and assemblies 42, 44 and 46 shown in FIGS. 1 to 8 with the addition of the designation ".1". Plant 20.1 and assembly 42.1 are substantially the same as plant 20 and assembly 42 shown in FIGS. 1 to 8 with the following exceptions.

Conveyors 52.1, 100.1, and 186.1 are flexible sidewall conveyors instead of belt conveyors. Flexible sidewall conveyors are belt conveyors with side walls and intermediate slates that allow them to convey uphill. Each conveyor comprises a plurality of receptacles that are hollow, open topped and substantially in the shape of rectangular prisms in this example, as shown by receptacle 198. The elevating sections 60.1, 110.1 and 187.1 of the conveyors 52.1, 100.1 and 186, respectively, extend in substantially vertical directions in this example. The conveyors 52.1, 100.1, 186.1 further include further horizontally-extending section 200, 202, and 204, respectively, which extend from their elevating sections to chutes 66.1, 116.1 and 192.1, respectively.

It will be appreciated that many further variations are possible within the scope of the invention described herein. For example, while send conveyors 52 and return conveyors 100 are shown, in another embodiment a looping and/or bending single conveyor, single chute, single drop zone, single feeder and separation assembly may be used. In this case, the conveyor may convey material to the drop zone, receive oversized material from the feeder, and again raise further unground material to be dropped within the same drop zone once more.

The conveyor described in FIGS. 1 to 8 includes belt conveyors. In the alternative, these conveyors may be in the form of tube conveyors, or sandwich conveyors, for example. A sandwich conveyor has a similar configuration to a belt conveyor but has a second belt on top of the material which allows a steeper angle.

Each of the assemblies 42, 44 and 46 may alternatively comprise of two, four, six or more send conveyors 52 arranged in series with one another and two, four, six or more return conveyors 100 operating in series with one another. Alternatively, each of the assemblies 42, 44 and 44 may be arranged themselves in series with each other, instead of in parallel with each other.

The feeders described herein may alternatively consist of belt feeders or apron feeders, for example.

Conveyor 26 of the feeder assembly 24 seen in FIG. 2 may alternatively be replaced with a plurality of individual conveyors from the material source for each of the impact grinding assemblies 42, 44 and 46.

Material discharging from the top of the product screen 174, seen in FIG. 7, may be alternatively directed to an unrelated grinding circuit with equipment suited to pebble size particles.

Slurry 184, comprising completely ground product, may be pumped separately to subsequent stages in the mineral processing circuit.

It will be understood by someone skilled in the art that many of the details provided above are by way of example only and are not intended to limit the scope of the invention which is to be determined with reference to at least the following claims.

What is claimed is:

1. An impact grinding assembly comprising:

a first conveyor for conveying at least partially unground material and a second conveyor for conveying at least partially unground material, each said conveyor having a lower end and an upper end; and a first vibrating impact plate and a second vibrating impact plate, each having a first end elevated relative to a spaced-apart second end, said first vibrating impact plate aligning below the upper end of the first conveyor to impact with said at least partially unground material from the first conveyor, with the first conveyor being positioned to drop the at least partially unground material from the upper end of the first conveyor onto the first vibrating impact plate such that the at least partially unground material from the first conveyor falls a distance similar to the height to which the at least partially unground material from the first conveyor is lifted by the first conveyor from the lower end of the first conveyor to the upper end of the first conveyor, the first vibrating impact plate aligning with the lower end of the second conveyor and operatively directing material thereon to the lower end of the second conveyor, said second vibrating impact plate aligning below the upper end of the second conveyor to receive said at least partially unground material from the second conveyor with the second conveyor being positioned to drop the at least partially unground material from the second conveyor onto the second vibrating impact plate such that the at least partially unground material from the second conveyor falls a distance similar to the height to which the at least partially unground material from the second conveyor is lifted by the second conveyor from the lower end of the second conveyor to the upper end of the second conveyor, the second vibrating impact plate aligning with the lower end of the first conveyor and operatively directing material thereon to the lower end of the first conveyor.

2. The assembly as claimed in claim 1 wherein at least one of the impact plates is part of a vibratory feeder, the vibratory feeder including a first portion in the form of said at least one of the vibrating impact plates and a second portion connected to and extending from the first portion, the second portion of the vibratory feeder comprising a material-separation grid.

3. The assembly as claimed in claim 1, further including a vibratory mechanism operatively connected to the first vibrating impact plate, the vibration mechanism having a vibration rate, and the assembly further including a control system which sends signals to the vibratory mechanism to control said vibration rate and thereby maintain a bed of material above said first vibrating impact plate onto which further unground material operatively impacts, said bed of material comprising part of said at least partially unground material from the first conveyor which has been dropped from the first conveyor towards the first vibrating impact plate.

4. The assembly as claimed in claim 2 further including a screen positioned below the material-separation grid and through which fully ground material passes.

5. The assembly as claimed in claim 1 wherein the conveyors are inclined, at least in part, in opposite directions.

6. The assembly as claimed in claim 1 further including a first chute extending from the upper end of the first conveyor to the first vibrating impact plate and a second chute extending from the upper end of the second conveyor to the second vibrating impact plate.

7. The assembly as claimed in claim 1 further including a material-separation grid positioned adjacent to the second vibrating impact plate, the material-separation grid selectively removing at least partially ground material from the conveyors.

8. The assembly as claimed in claim 7, further including mill balls which are moved along the second conveyor, the balls being dropped onto the at least partially unground material, creating at least in part the at least partially ground material thereby, and the balls being separated from the at least partially ground material and returned to the first conveyor via the material-separation grid.

9. The assembly as claimed in claim 7, wherein the at least partially ground material resulting from being dropped from the second conveyor includes fully ground material, wherein the assembly further includes a screen positioned below the material-separation grid and through which the fully ground material passes, and wherein the assembly further includes an intermediate conveyor, the balance of the at least partially ground material returning to the first conveyor via the intermediate conveyor.

10. The assembly as claimed in claim 1 wherein the conveyors are flexible sidewall conveyors.

11. The assembly as claimed in claim 1, further including a plurality of mill balls, the lower ends of the conveyors aligning with respective ones of the vibrating impact plates for operatively receiving the mill balls and the at least partially unground material, the mill balls and the at least partially unground material dropping from the upper ends of the conveyors, and the assembly further including a material separation assembly interposed between one of the vibrating impact plates and one of the conveyors, the separation assembly directing the mill balls back to said one of the conveyors and enabling partially ground material to pass therethrough.

12. An impact grinding plant comprising:

a plurality of the impact grinding assemblies as claimed in claim 1, each said impact grinding assembly further including a separation assembly for separating out ground material and operatively returning still unground material to corresponding conveyors for impacting with corresponding impact plates again; and a feeder assembly which selectively conveys unground material to respective ones of the conveyors of the impact grinding assemblies.

13. The plant as claimed in claim 12 wherein the impact grinding assemblies are arranged in parallel and the feeder assembly has a conveyor-feeding chute through which the unground material is selectively fed to respective ones of the impact grinding assemblies, the chute being moveable in a direction transverse to the impact grinding assemblies.

14. The assembly as claimed in claim 1, further including a first drop zone within which said at least partially unground material unimpededly drops, the first drop zone extending from the upper end of the first conveyor to the first vibrating impact plate, and a second drop zone within which said at least partially unground material unimpededly drops, the second drop zone extending from the upper end of the second conveyor to the second vibrating impact plate, each said drop zone extending in a vertical direction.

15. The assembly as claimed in claim 14 further including a first drop chute which extends around the first drop zone and a second drop chute which extends around the second drop zone.

16. The assembly as claimed in claim 1 wherein the second vibrating impact plate is a vibratory feeder and wherein the assembly is configured such that the percentage by mass flow of material passing over the vibratory feeder to continue circulation onto the first conveyor is in the range of 50 to 90%.

17. The impact grinding assembly as claimed in claim 1 wherein the second vibrating impact plate is a vibratory feeder and wherein the assembly is configured such that the percentage by mass flow of material passing over the vibratory feeder to continue circulation onto the first conveyor is in the range of 75 to 85%, with the second conveyor positioned to cause in the range of 15 to 25% of the material operatively colliding with the second vibrating impact plate to be fully ground so as to pass through a material separation assembly.

18. A method of impact grinding material, the method comprising:

elevating unground said material via a first conveyor from a lower end to an upper end thereof;

dropping the material onto a first vibrating impact surface such that the material falls a distance similar to the height to which the material on the first conveyor was lifted by the first conveyor from the lower end of the first conveyor to the upper end of the first conveyor;

conveying the material so dropped via the first vibrating impact surface to a lower end of a second conveyor aligned with the first vibrating impact surface;

elevating the material so conveyed from the lower end of the second conveyor to an upper end of the second conveyor;

dropping the material from the second conveyor onto a second vibrating impact surface such that the material falls a distance similar to the height to which the material on the second conveyor was lifted by the second conveyor from the lower end of the second conveyor to the upper end of the second conveyor, the second vibrating impact surface being aligned with the lower end of the first conveyor;

separating out ground said material having particle sizes no greater than a threshold particle size; and returning at least partially unground said material via the second vibrating impact surface back to the first conveyor to be dropped again.

19. The assembly as claimed in claim 1, wherein the first vibrating impact plate extends in a direction generally perpendicular to the at least partially unground material falling from the first conveyor, wherein the second vibrating impact plate extends in a direction generally perpendicular to the at least partially unground material falling from the second conveyor, wherein the first vibrating impact plate is generally level with the lower end of the second conveyor, and wherein the second vibrating impact plate is generally level the lower end of the first conveyor.

20. The assembly as claimed in claim 1, wherein the assembly is configured to primarily devote consumed energy to raising and dropping particles, with most grinding occurring using impact breakage.

21. The assembly as claimed in claim 1, further including a pair of vibratory pan feeders each comprising a respective said vibrating impact plate, each said feeder having a closed end and an open end which is spaced-apart from said closed end, with the closed ends of the feeders being only slightly elevated relative to the open ends of the feeders to enable material adjacent to the closed ends of the feeders to move via gravity and the feeders' vibration towards the open ends of the feeders.

* * * * *